US005506660A

United States Patent [19]

Rabb et al.

[11] Patent Number: 5,506,660

[45] Date of Patent: Apr. 9, 1996

[54] MULTI-PITCH PAPER AND IMAGE HANDLING ON SEAMED BELT

[75] Inventors: Khalid M. Rabb, Fairport; Michael L. Shaffer, Walworth; Robert M. Harwood, Farmington; Irwin Wagman, Pittsford, all of N.Y.

[73] Assignee: Xerox Corporation, Stamford, Conn.

[21] Appl. No.: 301,096

[22] Filed: Sep. 6, 1994

[51] Int. Cl.[6] ..... G03G 15/043

[52] U.S. Cl. ..... 355/208; 355/212; 355/218

[58] Field of Search ..... 355/208, 212, 355/218, 210; 250/559, 571, 559.01, 559.05, 559.07; 347/229, 248, 250; 358/300

[56] References Cited

U.S. PATENT DOCUMENTS

| | | | |
|---|---|---|---|
| 4,556,311 | 12/1985 | Tagoku | 355/212 |
| 4,967,232 | 10/1990 | Obara | 355/233 |
| 4,982,234 | 1/1991 | Fillion et al. | 355/209 |
| 5,173,733 | 12/1992 | Green | 355/208 |
| 5,218,406 | 6/1993 | Ebner | 355/205 |
| 5,218,456 | 6/1993 | Stegbauer et al. | 358/404 |
| 5,291,245 | 3/1994 | Charnitski et al. | 355/208 |
| 5,342,715 | 8/1994 | Kamath et al. | 355/212 |

FOREIGN PATENT DOCUMENTS

| | | |
|---|---|---|
| 0159740 | 10/1985 | European Pat. Off. . |
| 3-58060 | 3/1991 | Japan . |

*Primary Examiner*—Joan H. Pendegrass
*Assistant Examiner*—Nestor R. Ramirez
*Attorney, Agent, or Firm*—Ronald F. Chapuran

[57] ABSTRACT

A method of intermingling images of different sizes on a photosensitive surface and yet avoid the seam of the photosensitive surface and synchronize the transfer of the images to intermingled copy sheets of various sizes by determining the size of each image before projecting the image onto the photo sensitive surface; predicting the relationship of the image to the seam of the photosensitive surface; deciding that a given image would overlay the seam of the photosensitive surface, applying a timing adjustment to project the given image onto the photosensitive surface in avoidance of the seam of the photosensitive surface, and transferring each of the images including said given image from the photosensitive surface to copy sheets whereby images of different sizes are intermingled along the photosensitive surface and copy sheets of different sizes are intermingled along the copy sheet path.

8 Claims, 3 Drawing Sheets

MULTI-PITCH PAPER AND IMAGE HANDLING ON SEAMED BELT

BACKGROUND OF THE INVENTION

The invention relates to image handling on seamed belts and, more particularly, to the capability of mixing images of different sizes on a seamed belt and mixing copy sheets of different sizes associated with the images along a paper path.

Modern business and document needs oftentimes dictate the need for images of various sizes be interspersed along a photosensitive surface and transferred to associated copy sheets along a sheet path. A suitable control must be able to accurately and efficiently schedule the size variations of the images along the photosensitive surface to avoid the photosensitive surface seam. The control must also be able to select and coordinate the synchronization of the photosensitive surface and arrival of copy sheets from multiple sources at a transfer station.

It is known in the prior art to be able to provide selected documents in a set of documents with different features. For example, U.S. Pat. No. 4,982,234 discloses a user interface screen for programming different features for individual documents or groups of documents in a set of documents in a reproduction machine. In addition, U.S. Pat. No. 5,291,245 discloses a belt seam detection and process control device to avoid forming images across a photoreceptor seam.

One difficulty in prior art devices is that the control is not adapted to intermingle projected images of various sizes on the photosensitive surface and yet avoid projecting an image across the seam.

It is an object, therefore, of the present invention to provide a new and improved system for mixing projected images of various sizes on a photosensitive surface while avoiding the projection of an image across the photosensitive surface seam. Another object of the present invention is to be able to selectively adjust machine timing in order to intermingle projected images of various sizes on a photosensitive surface while avoiding the projection of an image across the photosensitive surface seam and to be able to synchronize the transfer of the images on the surface with the arrival of multi sized copy sheets at a transfer station. Other advantages of the present invention will become apparent as the following description proceeds, and the features characterizing the invention will be pointed out with particularity in the claims annexed to and forming a part of this specification.

SUMMARY OF THE INVENTION

A method of intermingling images of different sizes on a photosensitive surface and yet avoid the seam of the photosensitive surface and synchronize the transfer of the images to intermingled copy sheets of various sizes by determining the size of each image before projecting the image onto the photo sensitive surface; predicting the relationship of the image to the seam of the photosensitive surface; deciding that a given image would overlay the seam of the photosensitive surface, applying a timing adjustment to project the given image onto the photosensitive surface in avoidance of the seam of the photosensitive surface, and transferring each of the images from the photosensitive surface to suitable copy sheets.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
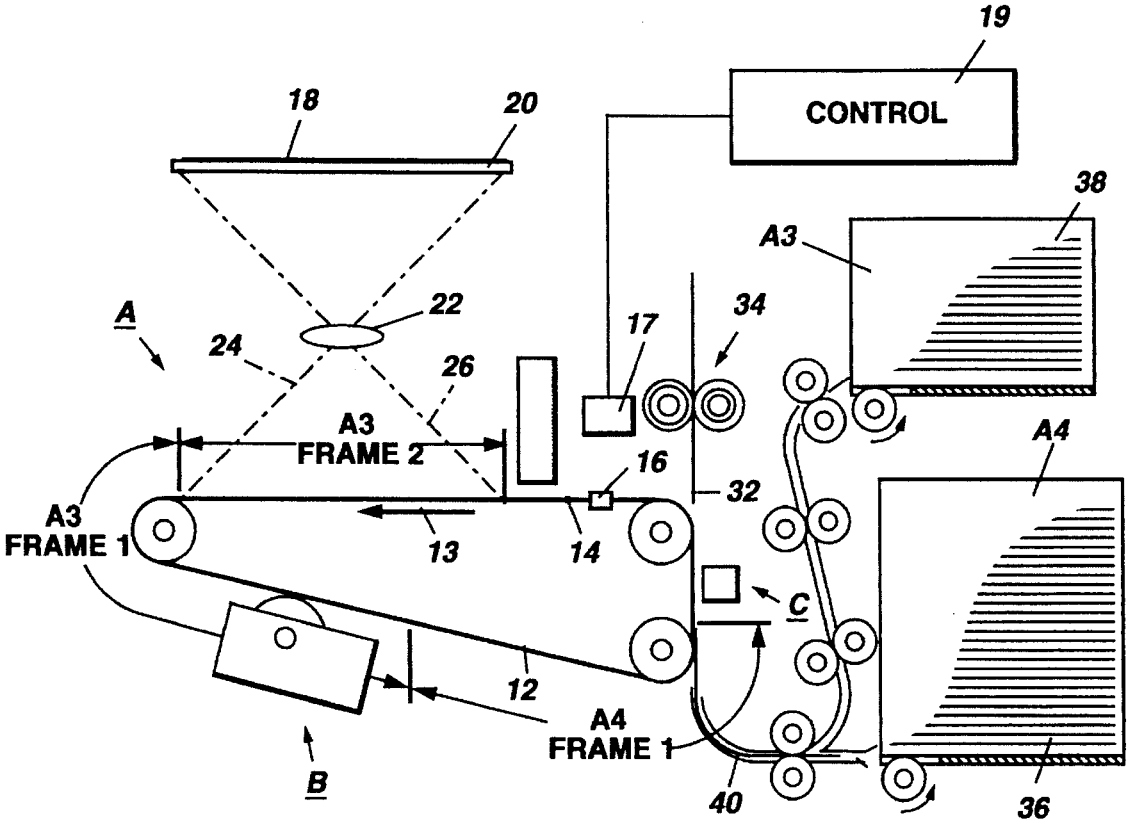
FIG. 1 is a plan view illustrating a typical reproduction machine incorporating the present invention.

With reference to FIG. 1, there is shown a photoreceptor belt 12 suitably mounted for moving in the direction of arrow 13, past various xerographic stations such as imaging station A, developer station B, image transfer station C. Photoreceptor 12 includes a belt seam 14, a non-image area joining the two ends of the photoreceptor belt, and belt hole 16 and sensor 17 for sensing the location of the belt hole 16 to determine the location of the seam 14. Sensor 17 as well as other not shown paper path sensors are suitably connected to control 19 A document 18 is illustrated disposed on platen 20 for projection of an image by means of lens 22 onto a section of the photoreceptor belt 12. In particular, as illustrated, light beams 24 and 26 show the boundaries of an image projected onto the photoreceptor belt having an an image size A3 identified as the A3 frame 2. The belt 12 is also shown with earlier projected images, in particular A3 frame 1 and A4 frame 1 at the transfer station C. Following transfer, copy sheets, illustrated by copy sheet 32, are stripped from the photoreceptor belt 12 as is well known in the art and delivered to a suitable fuser apparatus shown at 34. Suitable size copy sheets are provided from A3 paper storage 38 and A4 paper storage 36 and copy sheet 40 illustrates the next in line copy sheet to receive an image at transfer station C. It should be noted that control 19 as shown in FIG. 1 is any suitable control, for example, the controls disclosed in U.S. Pat. Nos. 5,218,406 and 5,218,456 incorporated herein.

It is known in prior art controls to calculate trail edge jam times for paper path sensors based on the process dimension of the sheet. Different trail edge jam times are also often required for sensors in different transports because the process speed of the sheet is different in each of the transports. In addition, trail edge jam times for a rotated sheet are different than the jam time for a non-rotated sheet because the process dimension will be different.

A solution to the control requirement of different jam times is the use of an information byte. A sheet information byte of two bytes of software information is passed through the base software along with each sheet. The information byte is a "personality profile" of each sheet, giving detail such as: feeder source, sheet destination, tab sheet, rotate sheet, and inverted sheet. However, due to real time constraints, and resource limitations, it is usually not possible to pass the sheet dimension information along with the sheet.

Figure 2:
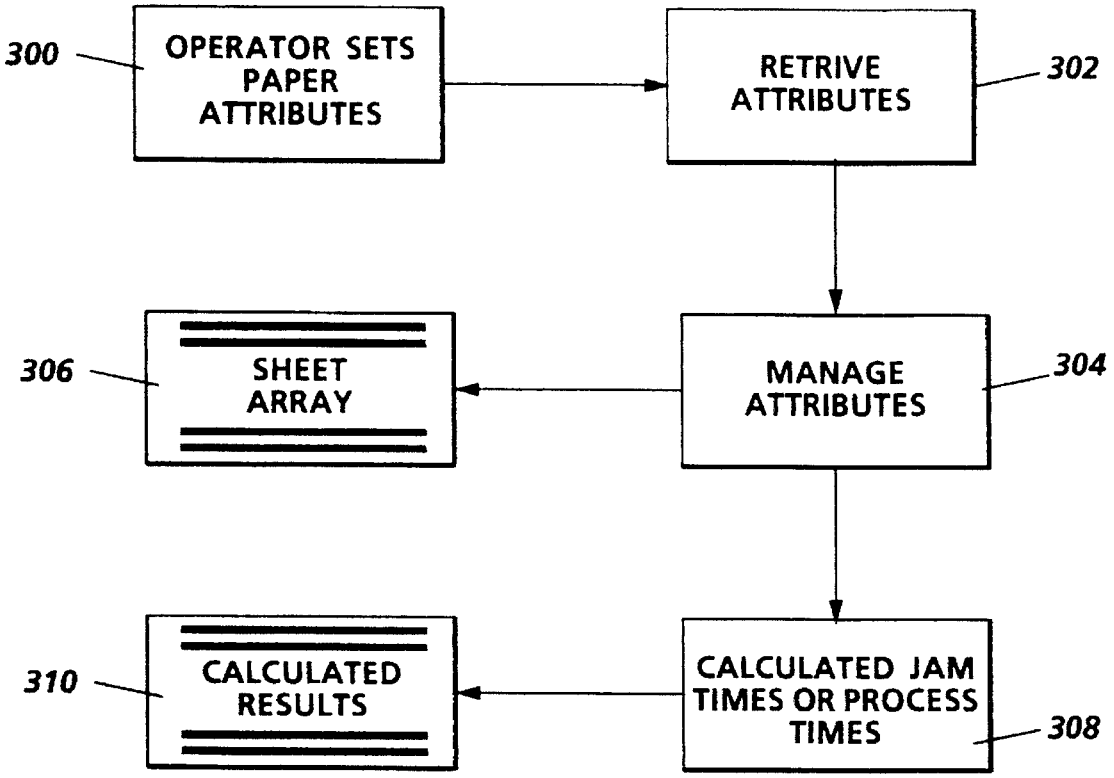
FIG. 2 illustrates the scheduling copy sheets of different characteristic along a paper path.
Figure 3:
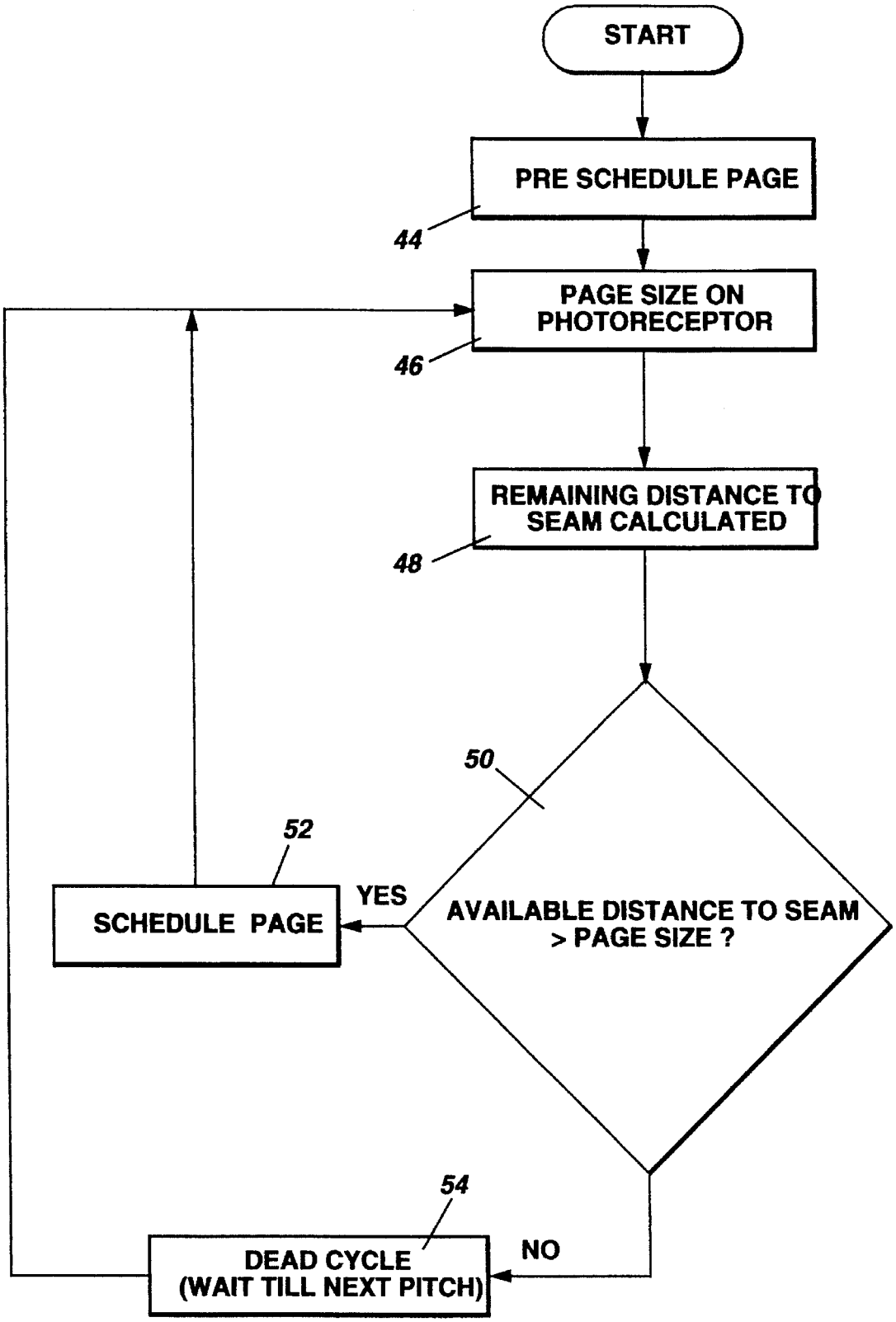
FIG. 3 is a flow chart illustrating multi-size image handling on a seamed photoreceptor belt in accordance with the present invention.

Therefore, tray size information is determined whenever the machine is powered up and thereafter whenever the size of the paper loaded into the tray changes. The control takes each pair of dimensions length and width and performs all necessary calculations such as jam indicator timing information related to various jam sensors. Thus, with reference to FIG. 2, block 300 illustrates the operator setting paper attributes. This can be accomplished by the operator setting a particular tray to hold a specific size copy sheet and sensors attached to the tray communicating the setting for paper size to the system control. Another option is merely for the operator at the user interface to enter various copy sheet attributes such as size and type for each of a set of given trays. Another option for determining copy sheet attributes such as size is for suitably positioned sensors at the copy sheet feed trays to sense the size of the copy sheets as sheets are fed onto a conveyor or transport.

Block 302 illustrates the retrieval of the attributes into a copy sheet attribute profile processor suitably located in the system control 19. The attributes can be generally retrieved by the profile processor on machine power up. It should be noted that the profile processor records and organizes paper attributes for a plurality of copy sheet sources. At block 304, the profile processor attributes such as sheet size are stored or located in a suitable memory location as illustrated by the sheet size array 306. Also for each copy sheet source, the profile processor calculates various jam times or process times as illustrated at block 308 and suitably stores the appropriate time periods in a suitable result store as shown at 310. It should be noted that each size or type of copy sheet may require several jam time periods for various sensors located throughout the machine along the paper path related to various transport characteristics and speed times required throughout the imaging process. Also as paper sizes are changed in any of the sources at any time, there is an update of the various jam and process times to relate to the changed paper size.

Unfortunately, few copiers/printers allow the use of different width paper size, for example, A4 and A3, without forcing the copier/printer to cycle down between paper changes. In addition, copiers/printers do not usually allow mixed paper widths without a number of dead cycles to enable to resynchronization of the xerographic process.

The control in accordance with the present invention, tracks each individual image and piece of paper or copy sheet in the machine. The control also tracks the current distance from the photoreceptor belt hole and thus the distance from the photoreceptor seam. In particular, the control tracks the distance remaining till the belt hole or seam is next encountered. This allows the non imageable area on the photoreceptor to be accommodated by making the decision as to whether or not an image to be projected can be scheduled based upon the knowledge of the current distance to seam as well as pre-knowledge of the next size or image size to be scheduled. For example, if the image area needed for the next image is less than the remaining distance from the seam then it is okay to image. Otherwise, there will be a dead cycle or pitch delay to allow the belt hole or seam to to bypass the imaging area.

This technique is illustrated in the flow chart. In particular, for example, a page or image is pre-scheduled as illustrated at block 44. At block 46 there is a determination as to the actual size on the photoreceptor of the pre-scheduled page or copy image. Next, as illustrated at block 48, there is a determination of the remaining distance to the seam of the photoreceptor and at decision block 50, the decision is made whether or not the available distance on the photoreceptor to the seam is greater than the page or copy image size. If the distance is greater than the image to be projected, then the page as scheduled as shown in block 52 and the system proceeds to look at the image size of the next pre-scheduled page or copy image. On the other hand, if the available distance on the photoreceptor from the point of projection of the image to the seam is less than or equal to the determined page or copy image size, the image is not scheduled. As illustrated at block 54, there is a dead cycle or wait until a next pitch to schedule the next page.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus having processing elements and a controller for projecting original images onto a photosensitive surface, the photosensitive surface having a seam, a method of intermingling along the photosensitive surface projected images having different sizes comprising the steps of:

determining the size of each original image before projecting the image onto the photo sensitive surface;

predicting the relationship of the image projected to the seam of the photosensitive surface;

deciding that a given original image would overlay the seam of the photosensitive surface, and applying a timing adjustment whereby the original image is projected onto the photosensitive surface in avoidance of the seam of the photosensitive surface and projected images of different sizes are intermingled along the photosensitive surface.

2. The method of claim 1 wherein the step of predicting the relationship of the projected image to the seam of the photosensitive surface includes the step of recognizing the location of the seam, determining the cumulative photosensitive surface supporting projected images, and calculating the distance of unexposed photosensitive surface to the location of the seam.

3. The method of claim 1 wherein the step of deciding that the given projected image would overlay the seam of the photosensitive surface includes the step of considering magnification factors.

4. The method of claim 1 wherein the step of applying a timing adjustment includes the step of skipping a processing apparatus pitch cycle.

5. In an image processing apparatus having processing elements including a copy sheet path, a photosensitive surface, and a controller for projecting original images onto the photosensitive surface for transfer to copy sheets, the photosensitive surface having a seam, the controller tracking the projection of original images onto the photosensitive surface and the movement of the copy sheets along the copy sheet path, a method of intermingling projected images and copy sheets of different sizes on the photosensitive surface and on the copy sheet path comprising the steps of:

determining the size of each original image before projecting the image onto the photo sensitive surface;

predicting the relationship of the projected image to the seam of the photosensitive surface;

deciding that a given original image would overlay the seam of the photosensitive surface, applying a timing adjustment to project the given original image onto the photosensitive surface in avoidance of the seam of the photosensitive surface, and transferring each of the projected images including said given original image from the photosensitive surface to copy sheets whereby images of different sizes are intermingled along the photosensitive surface and copy sheets of different sizes are intermingled along the copy sheet path.

6. The method of claim 5 including a plurality of sources of said copy sheets and wherein the step of transferring each of the images including said given image from the photosensitive surface to copy sheets includes the step of identifying the source of each copy sheet.

7. The method of claim 5 wherein the step of transferring each of the images includes the step of setting registration timing.

8. A method of intermingling projected images of different sizes on a photosensitive surface and avoid the seam of the photosensitive surface and synchronize the transfer of the projected images to intermingled copy sheets of various sizes by determining the size of an original image before projecting the image onto the photosensitive surface; predicting the relationship of the original image to the seam of the photosensitive surface; deciding that a given original image would overlay the seam of the photosensitive surface, applying a timing adjustment to project the given original image onto the photosensitive surface in avoidance of the seam of the photosensitive surface, and transferring each of the projected images including said given original image from the photosensitive surface to copy sheets whereby images of different sizes are intermingled along the photosensitive surface and copy sheets of different sizes are intermingled along the copy sheet path.

* * * * *